US008671646B2

(12) United States Patent
Zhuo et al.

(10) Patent No.: US 8,671,646 B2
(45) Date of Patent: Mar. 18, 2014

(54) LAYER-BY-LAYER DOUBLE-HOOP SUNFLOWER-SHAPED CABLE DOME STRUCTURE AND ITS CONSTRUCTION METHOD

(75) Inventors: Xin Zhuo, Hangzhou (CN); Miaofu Wang, Hangzhou (CN); Shilin Dong, Hangzhou (CN)

(73) Assignees: Zhejiang University, Hangzhou, Zhejiang Province (CN); Zhejiang Zhancheng Construction Group Co., Ltd., Hangzhou, Zhejiang Province (CN)

( * ) Notice: Subject to any disclaimer, the term of this patent is extended or adjusted under 35 U.S.C. 154(b) by 2 days.

(21) Appl. No.: 13/394,032

(22) PCT Filed: Aug. 27, 2010

(86) PCT No.: PCT/CN2010/076408

§ 371 (c)(1), (2), (4) Date: Mar. 2, 2012

(87) PCT Pub. No.: WO2011/026408

PCT Pub. Date: Mar. 10, 2011

(65) Prior Publication Data

US 2012/0159872 A1 Jun. 28, 2012

(30) Foreign Application Priority Data

Sep. 3, 2009 (CN) ..... 2009 1 0102206

(51) Int. Cl.
*E04B 1/34* (2006.01)

(52) U.S. Cl.
USPC ..... 52/745.07; 52/81.1

(58) Field of Classification Search
USPC ..... 52/80.1, 80.2, 81.1, 81.2, 81.3, 81.5, 52/639, 644, 745.07, 92.1, 655.1, 653.1, 52/656.9, 646; 403/169–171, 176, 403/217–219
See application file for complete search history.

(56) References Cited

U.S. PATENT DOCUMENTS 5,371,983 A 12/1994 Kawaguchi et al.
5,440,840 A * 8/1995 Levy ..... 52/83

(Continued)

FOREIGN PATENT DOCUMENTS

CN 101158195 A 4/2008
CN 101225686 A 7/2008
CN 101260705 A 9/2008

(Continued)

*Primary Examiner* — Brian Glessner
*Assistant Examiner* — Beth Stephan
(74) *Attorney, Agent, or Firm* — Jacobson Holman PLLC; Jiwen Chen

(57) ABSTRACT

A cable dome structure comprises a top circle and circles of vertical jack posts supported by radiating and hoop cables. The upper and lower ends of the jack post have an upper and a lower cable bar nodes, respectively. The upper cable bar node is connected with two upper radiating cables of present circle at one side, two upper radiating cables of the circle above and two lower radiating cables of the circle above at another side and an upper hoop cable connecting the middle of the upper cable bar node. The lower cable bar node of the present circle at the same side of the upper radiating cables is connected with two lower radiating cables of the present circle and a lower hoop cable connecting the middle of the lower cable bar node. The top circle comprises an upper and a lower cable bar nodes and an elastic pole.

5 Claims, 2 Drawing Sheets

(56) References Cited

U.S. PATENT DOCUMENTS

| | | | | |
|---|---|---|---|---|
| 5,704,169 | A * | 1/1998 | Richter | 52/81.2 |
| 6,192,634 | B1 * | 2/2001 | Lopez | 52/81.2 |
| 6,286,282 | B1 * | 9/2001 | Castano | 52/653.2 |
| 7,143,550 | B1 * | 12/2006 | Lopez | 52/81.3 |
| 8,074,404 | B2 * | 12/2011 | Zhang | 52/83 |

FOREIGN PATENT DOCUMENTS

| | | | |
|---|---|---|---|
| CN | 101314972 | A | 12/2008 |
| CN | 201193372 | Y | 2/2009 |

* cited by examiner

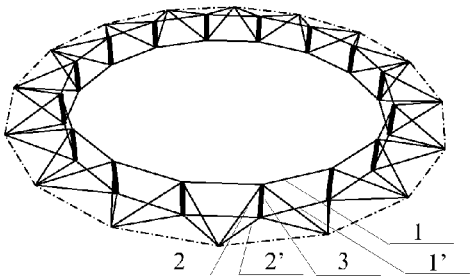
FIG. 1
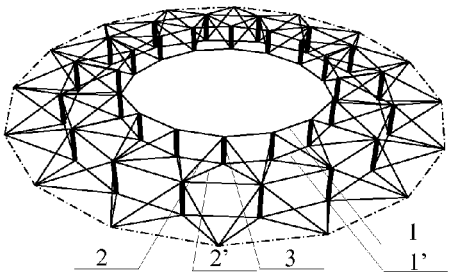
FIG. 2
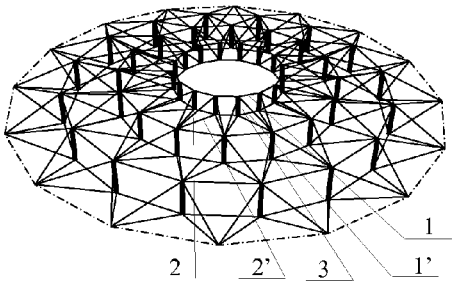
FIG. 3
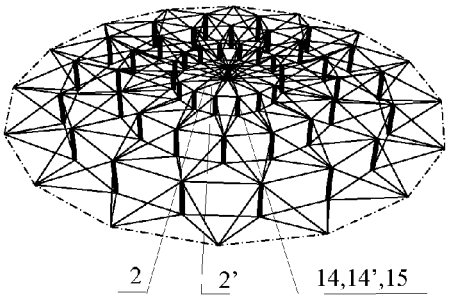
FIG. 4
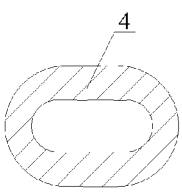
FIG. 5a
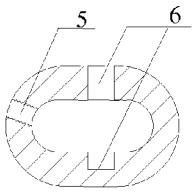
FIG. 5b
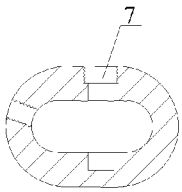
FIG. 5c
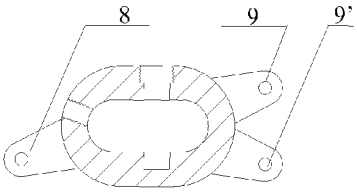
FIG. 5d
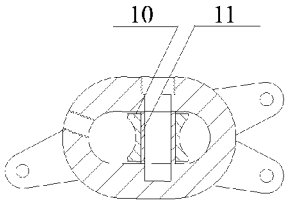
FIG. 5e
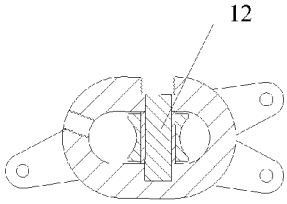
FIG. 5f
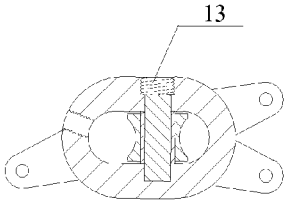
FIG. 5g
FIG. 5

LAYER-BY-LAYER DOUBLE-HOOP SUNFLOWER-SHAPED CABLE DOME STRUCTURE AND ITS CONSTRUCTION METHOD

This is a U.S. national stage application of PCT Application No. PCT/CN2010/076408 under 35 U.S.C. 371, filed Aug. 27, 2010 in Chinese, claiming the priority benefit of Chinese Application No. 200910102206.4, filed Sep. 3, 2009, which is hereby incorporated by reference.

TECHNICAL FIELD

This invention relates to a sunflower-shaped cable dome structure system and its construction method, specifically it relates to a layer-by-layer double-hoop sunflower-shaped cable dome structure and its construction method.

BACKGROUND ART

Existing sunflower-shaped cable dome structures are of a flexible system comprising hoop cables, ridge cables (first quarter stayed cables), stayed cables (last quarter stayed cables), jack posts and cable bar nodes, the rigidity of which is provided by adding pre-stress. For each cycle, there is only one hoop cable connected with the lower cable bar nodes of jack post. The cable bar nodes are connected with ridge cables (bars), stayed cables (bars) and hoop cables in a relation of rotatable hinge joint. In general, the constructed projects of sunflower-shaped cable dome structure use the method of pre-stress construction that pulls each stayed cable or lifts each jack post. In order to guarantee the precision of pre-stress of each cable, it is needed to generate evenly pre-stress at each stayed cable or each jack post at the same time. This construction method requires lots of lifting jacks to carry out pulling or lifting of the groups at the same time under a real-time control of computer. The existing cable dome structures require strictly on the precision of processing of the parts and the precision.

Though the cable domes are of an advanced form of structure with the lowest dead weight and the highest structure efficiency amongst the large-span structures, only a few of enterprises of several developed countries are capable of designing and constructing large-span cable dome structures. The key bottleneck is that the way of construction and the construction method of cable dome structure have decided that its successful construction relies a lot on the precision of manufacture of the parts and the precision of construction of pre-stress. Otherwise, it is impossible to construct well or even impossible to complete construction.

BRIEF SUMMARY OF THE INVENTION

The purpose of the present invention is to provide a layer-by-layer double-hoop sunflower-shaped cable dome structure and its construction and formation method. By changing the existing sunflower-shaped cable dome structure system and its method of construction and formation, it is possible to abandon excessive dependence on the precision of manufacture of the parts and the precision of construction of pre-stress and achieve an easier method of construction and formation, better construction quality and lower construction cost.

The proposed new sunflower-shaped cable dome structure is called as a layer-by-layer double-hoop sunflower-shaped cable dome structure and its key technologies lie in:

(1) changing the existing sunflower-shaped cable dome structure system with only a lower hoop cable in each layer into a sunflower-shaped cable dome structure system with an upper continuous run-through hoop cable and a lower continuous run-through hoop cable in each layer and simplifying the existing method of integral installation and integral pulling or lifting cable-bar structure that is quite difficult into a method of construction and formation of layer-by-layer installation, layer-by-layer pulling and adding cable-bar structure by layer;

(2) By changing the configuration of cable bar nodes, the hoop cables and the cable bar nodes form rotatable relation of hinge joint in construction to make the loss of pre-stress to almost nil when the hoop cable passes through each cable bar node, the adjacent two hoop cables have same internal force and finally the internal forces of the parts of hoop cable, stayed cable (bar) and jack post of the whole structure match with the design.

(3) After completing construction of the whole structure, it is possible to lock conveniently the hoop cables with each cable bar node and form hinge joint without sliding but turning to improve the bearing of the whole structure.

(4) Simplifying the pre-stress construction method of group control and pulling many stayed cables (bars) at several spots at the same time or lifting many jack posts to the pre-stress construction method pulling an upper hoop cable and a lower hoop cable at the same time.

The Technical Solutions Taken by the Present Invention are:

I. A Layer-by-Layer Double-Hoop Sunflower-Shaped Cable Dome Structure

Said structure comprises the cycles of jack posts of elevation having several units arranged with same space in each layer with same geometric characters and of same quantity except of the top layer, is characterized that: the upper end and the lower end of the jack post of each unit are installed with an upper cable bar node and a lower cable bar node respectively. The upper cable bar node is connected with two upper stayed cables of the present layer at one side, two upper stayed cables of the layer above and two lower stayed cables of the layer above at another side and an upper hoop cable going through the middle of the upper cable bar node. The lower cable bar node is connected with two lower stayed cables of the present layer and a lower hoop cable going through the middle of the lower cable bar node.

The top layer comprises an upper cable bar node, a lower cable bar node and an elastic jack post. The upper cable bar node is connected with all upper stayed cables of the top layer and the lower cable bar node is connected with all lower stayed cables of the top layer. The elastic jack post comprises a jack post having left-hand thread and a jack post having right-hand thread and a bushing.

Said upper cable bar node is an elliptic steel ring, a narrow side of said elliptic steel ring is welded with a first hanger lug and a second hanger lug connected respectively with upper stayed cables of the present layer, the first and the second hanger lugs are connected respectively with the upper stayed cables of the present layer, and another narrow side of said elliptic steel ring is welded with a third hanger lug and a fourth hanger lug connected respectively with two upper stayed cables of the layer above and with a fifth hanger lug and a sixth hanger lug connected respectively with two lower stayed cables of the layer above, the third and the fourth hanger lugs are connected respectively with the own upper stayed cables of the layer above, the fifth and the sixth hanger lugs are connected respectively with the own lower stayed cables of the layer above, and between two wide sides of said elliptic steel ring a hollow concaved ring is installed with one side of which having a sliding connection with the upper hoop cable.

Said lower cable bar node is another elliptic steel ring, a narrow side of said elliptic steel ring is welded with a seventh hanger lug and an eighth hanger lug connected respectively with lower stayed cables of the present layer, the seventh and the eighth hanger lugs are connected respectively with the lower stayed cables of the present layer, and between two wide sides of said elliptic steel ring a hollow concaved ring is installed with one side of which having a sliding connection with the lower hoop cable.

Said upper cable bar node of the top layer is arranged with hanger lugs of the corresponding number of all upper stayed cables of the top layer with same interval and the hanger lungs of the corresponding number are connected respectively with all upper stayed cables of the top layer, said lower cable bar node of the top layer is arranged with hanger lugs of the corresponding number of all lower stayed cables of the top layer with same interval and the hanger lungs of the corresponding number are connected respectively with all lower stayed cables of the top layer.

II. A Construction Method of Layer-by-Layer Double-Hoop Sunflower-Shaped Cable Dome Structure Said method comprises the cycles of jack posts of elevation having several units arranged with same space in each layer with same geometric characters and of same quantity except of the top layer, is characterized that: the upper end and the lower end of the jack post of each unit are installed with an upper cable bar node and a lower cable bar node respectively. The upper cable bar node is connected with two upper stayed cables of the present layer at one side, two upper stayed cables of the layer above and two lower stayed cables of the layer above at another side and an upper hoop cable going through the middle of the upper cable bar node. The lower cable bar node is connected with two lower stayed cables of the present layer and a lower hoop cable going through the middle of the lower cable bar node.

The top layer comprises an upper cable bar node, a lower cable bar node and an elastic jack post. The upper cable bar node is connected with all upper stayed cables of the top layer and the lower cable bar node is connected with all lower stayed cables of the top layer. The elastic jack post comprises a jack post having left-hand thread, a jack post having right-hand thread and a bushing.

The steps for installation and integral construction are as follow:

(1) Install and connect an end of upper/lower stayed cable of the first layer with the base of the building and another end of upper/lower stayed cable of the first layer with the upper/lower cable bar node at the end of the corresponding jack post of the first layer, install an upper/lower hoop cable inside the upper/lower cable bar nodes, at the same time pull the upper hoop cable and the lower hoop cable of the first layer for forming a stable and self-balanced open cable bar structure of one layer.

(2) Install and connect an end of upper/lower stayed cable of the second layer with the upper cable bar node of the first layer and another end of upper/lower stayed cable of the second layer with the upper/lower cable bar node at the end of the corresponding jack post of the second layer, install an upper hoop cable and a lower hoop cable of the second layer inside the upper cable bar nodes and the lower cable bar nodes respectively, at the same time pull the upper hoop cable and the lower hoop cable of the second layer for forming a stable and self-balanced open cable bar structure of two layers.

(3) Similarly, complete installation and pre-stress construction of other layers. For the top layer without hoop cables, the method of elongating the elastic jack post in that layer can be used for introducing pre-stress, till the construction of the integral cable dome structure is done.

(4) After construction of the structure, lock and fix the hoop cables and the cable bar nodes to form hinge joint without sliding but turning, then, construct the roof on the structure.

III. Another Construction Method of Layer-by-Layer Double-Hoop Sunflower-Shaped Cable Dome Structure Said method comprises the cycles of jack posts of elevation having several units arranged with same space in each layer with same geometric characters and of same quantity except of the top layer, is characterized that: the upper end and the lower end of the jack post of each unit are installed with an upper cable bar node and a lower cable bar node respectively. The upper cable bar node is connected with two upper stayed cables of the present layer at one side, two upper stayed cables of the layer above and two lower stayed cables of the layer above at another side and an upper hoop cable going through the middle of the upper cable bar node. The lower cable bar node is connected with two lower stayed cables of the present layer and a lower hoop cable going through the middle of the lower cable bar node.

The top layer comprises an upper cable bar node, a lower cable bar node and an elastic jack post. The upper cable bar node is connected with all upper stayed cables of the top layer and the lower cable bar node is connected with all lower stayed cables of the top layer. The elastic jack post comprises a jack post having left-hand thread, a jack post having right-hand thread and a bushing.

The steps for installation and integral construction are as follow:

(1) Install and connect an end of upper/lower stayed cable of the first layer with the base of the building and another end of upper/lower stayed cable of the first layer with the upper/lower cable bar node at the end of the corresponding jack post of the first layer, install an upper/lower hoop cable inside the upper/lower cable bar nodes, connect an end of upper/lower stayed cable of the second layer with the upper cable bar node of the first layer, connect another end of upper/lower stayed cable of the second layer with the upper/lower cable bar node at the end of the corresponding jack post of the second layer, install an upper/lower hoop cable of the second layer inside the upper/lower cable bar nodes, finish the connection of the parts of the whole cable dome structure in the same manner.

(2) Pull at the same time the upper hoop cables and the lower hoop cables layer by layer. For the top layer without hoop cables, the method of elongating the elastic jack post in that layer can be used for introducing pre-stress, till the construction of the integral cable dome structure is done.

(3) After construction of the cable dome structure, lock and fix the hoop cables and the cable bar nodes to form hinge joint without sliding but turning, then, construct the roof on the structure.

Comparing with the background technologies, the present invention has following advantages:

1. High precision of pre-stress construction. During construction and formation, new cable bar nodes and hoop cables have a relation of sliding hinge joint and the friction force between them is almost of nil. The internal forces between the sections of cable of each hoop cable, between the upper stayed cables (bars), between the lower stayed cables (bars) and between the jack posts of each layer could always be same or almost same under the action of pre-stress. In the period of construction and formation, the new sunflower-shaped cable dome structure system shows a strengthened coordination ability of distortion of structure, a reduced sensibility of precision of control of pre-stress concerned with the errors of the parts made and an easier control of high precision of construction of pre-stress of structure, under the action of pre-stress. High precision quality of pre-stress construction guarantees the mechanical performance of the whole structure.

2. Easy construction method and high working efficiency. Other than the existing pre-stress construction method of pulling many stayed cables or lifting many jack posts of the structure in group, the pre-stress introduction method that carries out upward the installation layer by layer and pulling only one upper hoop cable and one lower hoop cable of each layer at the same time layer by layer reduces the difficulties of construction, has high working efficiency and is easy for control.

3. Low construction cost. The pre-stress introduction method of pulling only one upper hoop cable and one lower hoop cable of each layer requires simple pulling equipment and control method. At the same time, the friction force between the cable bar nodes and the hoop cables is almost of nil, which is convenient for the control of precision of pre-stress construction, avoids the recourses of time, personnel and materials for adjusting repeatedly the cable force and reduces the construction cost greatly.

4. The structure is safe for usage. After construction, the relation between the cable bar nodes and the hoop cables is changed from sliding hinge joint to rotatable hinge joint that cannot slide, which improves the bearing capacity of the whole structure.

BRIEF DESCRIPTION OF THE SEVERAL VIEWS OF THE DRAWINGS

FIG. 1 is a 3D perspective drawing of the formation of the cable bar structure of the first layer of the layer-by-layer double-hoop sunflower-shaped cable dome.

FIG. 2 is a 3D perspective drawing of the formation of the cable bar structure of the second layer of the layer-by-layer double-hoop sunflower-shaped cable dome.

FIG. 3 is a 3D perspective drawing of the formation of the cable bar structure of the third layer of the layer-by-layer double-hoop sunflower-shaped cable dome.

FIG. 4 is a 3D perspective drawing of the formation of the cable bar structure of the top layer of the layer-by-layer double-hoop sunflower-shaped cable dome.

FIG. 5 is a flow chart of preparation of upper cable bar nodes of the layer-by-layer double-hoop sunflower-shaped cable dome.

Figure 6:
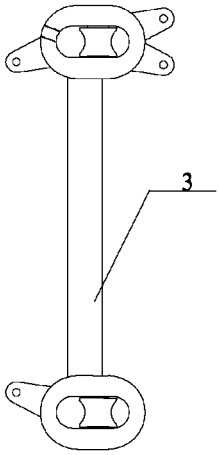
FIG. 6 is a vertical view of the composite member of upper cable bar nodes, lower cable bar nodes and jack posts.
Figure 7:
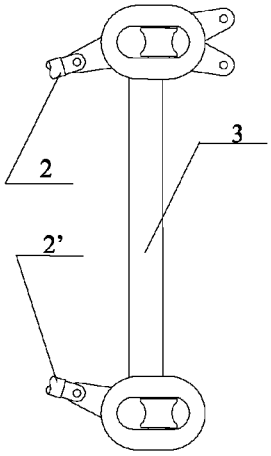
FIG. 7 is a vertical view of the connection of the composite member of upper cable bar nodes, lower cable bar nodes and jack posts and the upper stayed cables (bars) and the lower stayed cables (bars) of the present layer.
Figure 8:
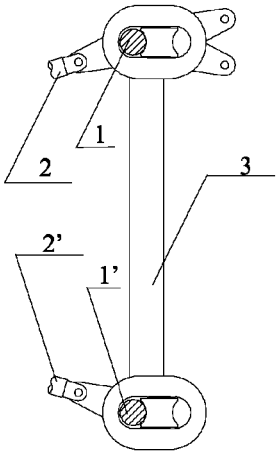
FIG. 8 is a vertical view of the upper cable bar nodes and the lower cable bar nodes after installing the upper hoop cable and the lower hoop cable.
Figure 9:
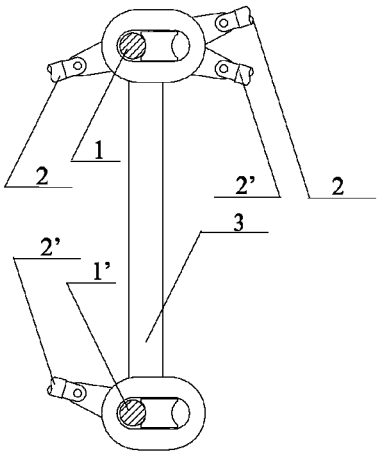
FIG. 9 is a vertical view of the upper cable bar node after installing the upper stayed cables (bars) and the lower stayed cables (bars) of the layer above.

In which: 1. upper hoop cable, 1'. lower hoop cable, 2. upper stayed cable (bar), 2'. lower stayed cable (bar), 3. jack post, 4. elliptic steel ring, 5. bolt hole, 6. round hole, 7. screw hole, 8. hanger lug, 9. hanger lug, 9'. hanger lug, 10. hollow concaved ring, 11. copper ring, 12. cylinder axis, 13. short screw, 14. jack post having left-hand thread, 14'. jack post having left-hand thread, 15. bushing with thread inside, 16. bolt

DETAILED DESCRIPTION OF THE INVENTION

The present invention is explained in further combining with the attached drawings and the execution examples.

As shown in FIG. 1, FIG. 2, FIG. 3 and FIG. 4, the present invention comprises the cycles of jack posts 3 of elevation having several units arranged with same space in each layer with same geometric characters and of same quantity except of the top layer. The upper end and the lower end of jack post 3 of each unit are installed with an upper cable bar node and a lower cable bar node. The upper cable bar node is connected with two upper stayed cables (bars) 2 of the present layer at one side, two upper stayed cables (bars) 2 of the layer above and two lower stayed cables (bars) 2' of the layer above at another side and an upper hoop cable 1 going through the middle of the upper cable bar node. The lower cable bar node is connected with two lower stayed cables (bars) 2' of the present layer and a lower hoop cable 1' going through the middle of the lower cable bar node.

As shown in FIG. 5*a*, FIG. 5*b*, FIG. 5*c*, FIG. 5*d*, FIG. 5*e*, FIG. 5*f*, FIG. 5*g*, FIG. 12 and FIG. 13, said upper cable bar node is an elliptic steel ring 4, a narrow side of said elliptic steel ring 4 is welded with a first hanger lug and a second hanger lug 8 connected respectively with the upper stayed cables (bars) 2 of the present layer, the first and the second hanger lugs 8 are connected respectively with the upper stayed cables (bars) 2 of the present layer, and another narrow side of said elliptic steel ring 4 is welded with a third hanger lug and a fourth hanger lug 9 connected respectively with two upper stayed cables(bars) 2 of the layer above and with a fifth hanger lug and a sixth hanger lug 9' connected respectively with two lower stayed cables (bars) 2' of the layer above, the third and the fourth hanger lugs 9 are connected respectively with the own upper stayed cables (bars) 2 of the layer above, the fifth and the sixth hanger lugs 9' are connected respectively with the own lower stayed cables (bars) 2' of the layer above, and between two wide sides of said elliptic steel ring 4 a hollow concaved ring 10 is installed with one side of which having a sliding connection with the upper hoop cable 1.

Said lower cable bar node is another elliptic steel ring 4, a narrow side of said elliptic steel ring 4 is welded with a seventh hanger lug and an eighth hanger lug 8 connected respectively with the lower stayed cables (bars) 2' of the present layer, the seventh and the eighth hanger lugs 8 are connected respectively with the lower stayed cables (bars) 2' of the present layer, and between two wide sides of said elliptic steel ring 4 a hollow concaved ring 10 is installed with one side of which 10 having a sliding connection with the lower hoop cable 1'.

Figure 10:
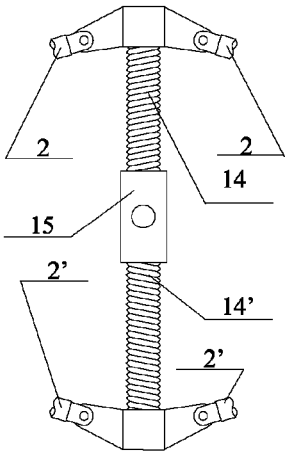
FIG. 10 is a vertical view of the configuration of the jack post of the top layer.
Figure 11:
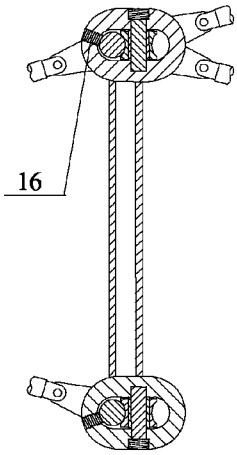
FIG. 11 is a section plan after locking and fixing the upper hoop cables and the lower hoop cables with the upper cable bar nodes and the lower cable bar nodes.
Figure 12:
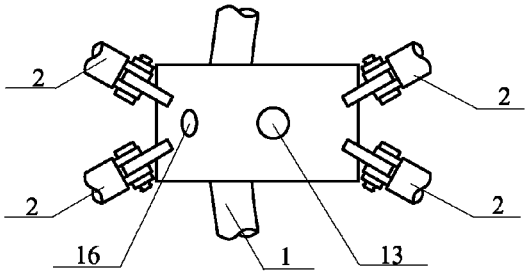
FIG. 12 is a top view of the upper cable bar nodes and concerned parts.
Figure 13:
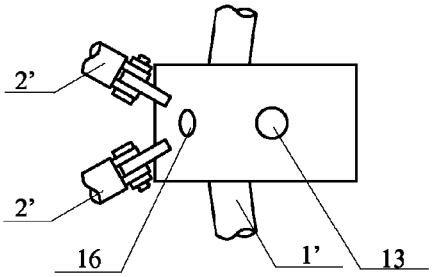
FIG. 13 is a top view of the lower cable bar nodes and concerned parts

As shown in FIG. 10, said top layer comprises an upper cable bar node, a lower cable bar node and an elastic jack post. The upper cable bar nodes of the top layer are arranged with the hanger lugs of the corresponding number of all upper stayed cables (bars) 2 of the top layer with same interval and the hanger lungs of the corresponding number are connected respectively with all upper stayed cables (bars) 2 of the top layer. The lower cable bar nodes of the top layer are arranged with the hanger lugs of the corresponding number of all lower stayed cables (bars) 2' of the top layer with same interval and the hanger lungs of the corresponding number are connected respectively with all lower stayed cables (bars) 2' of the top layer. The elastic jack post comprises a jack post having left-hand thread 14, a jack post having right-hand thread 14' and a bushing 15.

Implementation Examples

I. Configuration and Preparation of Cable Bar Node

Taking the example of the layer-by-layer double-hoop sunflower-shaped cable dome structure as shown in FIG. 4, the parts concerned with cable bar nodes comprise upper hoop cables 1, lower hoop cables 1', upper stayed cables (bars) 2, lower stayed cables (bars) 2' and jack posts 3.

The process of preparation of the upper cable bar node is shown in FIG. 5*a*, FIG. 5*b*, FIG. 5*c*, FIG. 5*d*, FIG. 5*e*, FIG. 5*f*, FIG. 5*g*, FIG. 12 and FIG. 13. Process an elliptic steel ring 4 by foundry or cutting. Drill a bolt hole 5 at the side of a narrow side of the elliptic steel ring 4. Process a screw hole 7 at the upper part of round hole 6 on a wide side of the elliptic steel ring 4. Weld the hanger lug 8 that is connected with the upper stayed cable (bar) 2 at an end of a narrow side of the elliptic steel ring 4. Weld two symmetrically-arranged hanger lugs 9 and two symmetrically-arranged hanger lugs 9' that are connected respectively with the upper stayed cables (bars) and the lower stayed cables (bars) of the layer above. The inner diameter of the hollow concaved ring 10 is slightly smaller than the external diameter of the copper ring 11. These two have an interference fit. Install the copper ring 11 into the hole of the hollow concaved ring 10 by shrinkage or pressing. Install the composite member of the copper ring 11 and the hollow concaved ring 10 between the two wide sides of the elliptic steel ring 4. Make a cylinder axis 12 the external diameter of which is same as the inner diameter of the copper ring 11. These two have a clearance fit. Insert the cylinder axis 12 into the hole of the copper ring 11. Screw the short bolt 13 into the screw hole 7 to position the cylinder axis 12 axially.

As shown in FIG. 6, comparing with the upper cable bar node, the lower cable bar node has the same structure and preparation method except that it doesn't have two symmetrically-arranged hanger lugs 9 and two symmetrically-arranged hanger lugs 9' connected with the upper stayed cables (bars). The jack post 3 has a rigid connection with the upper cable bar node and the lower cable bar node by welding with them at two ends.

(1) Method of shrinkage. Utilizing the metal's property of expansion on heating and contraction on cooling, before the assembly, freeze the internal member to make it shrunk. Then insert the internal member into the enveloping part at the time of assembly. When it is recovered to the same temperature, the internal part is expanded and forms an integer with the enveloping part. Because the two are metal materials having same or similar coefficient of thermal expansion, they have consistent holding force at the same temperature no matter how the external temperature changes. The method of shrinkage can result in rather high holding force and good assembly quality. In addition, the contact surface will not be scraped as the method of pressing.

(2) Method of pressing. At normal temperature, press the internal member into the enveloping part by the function of hit or pressure and let them form an interference fit. In the process of entering, the contact surface might be damaged and the attachment strength of connection will be reduced. So, adequate lubricant at the contact surface will result in better assembly quality. When the interference is small, this method is always used for the assembly of interference fit.

II. A Construction Method of Layer-by-Layer Double-Hoop Sunflower-Shaped Cable Dome Structure As shown in FIG. 4, FIG. 7, FIG. 8, FIG. 9, FIG. 12 and FIG. 13, comprising the cycles of jack posts 3 of elevation having several units arranged with same space in each layer with same geometric characters and of same quantity except of the top layer, it is characterized that: the upper end and the lower end of jack post 3 of each unit are installed with an upper cable bar node and a lower cable bar node. The upper cable bar node is connected with two upper stayed cables (bars) 2 of the present layer at one side, two upper stayed cables (bars) 2 of the layer above and two lower stayed cables (bars) 2' of the layer above at another side and an upper hoop cable going through the middle of the upper cable bar node 1. The lower cable bar node is connected with two lower stayed cables (bars) 2' of the present layer and a lower hoop cable 1' going through the middle of the lower cable bar node.

As shown in FIG. 10, the top layer comprises an upper cable bar node, a lower cable bar node and an elastic jack post. The upper cable bar node is connected with all upper stayed cables (bars) 2 of the top layer and the lower cable bar node is connected with all lower stayed cables (bars) 2' of the top layer. The elastic jack post comprises a jack post having left-hand thread 14, a jack post having right-hand thread 14' and a bushing 15.

(1) Install and connect an end of the upper stayed cable (bar) 2 and the lower stayed cable (bar) 2' of the first layer with the base of the building and another end of the upper stayed cable (bar) 2 and the lower stayed cable (bar) 2' of the first layer with the upper cable bar node and the lower cable bar node of the two ends of the corresponding jack post 3 of the first layer, install the upper hoop cable 1 and the lower hoop cable 1' inside the upper cable bar node and the lower cable bar node, at the same time pull the upper hoop cable 1 and the lower hoop cable 1' of the first layer for forming a stable and self-balanced open cable bar structure of one layer.

(2) Install and connect an end of the upper stayed cable (bar) 2 and the lower stayed cable (bar) 2' of the second layer with the upper cable bar node of the first layer and another end of the upper stayed cable (bar) 2 and the lower stayed cable (bar) 2' of the second layer with the upper cable bar node and the lower cable bar node of the two ends of the corresponding jack post 3 of the second layer, install the upper hoop cable 1 and the lower hoop cable 1' of the second layer inside the upper cable bar node and the lower cable bar node, at the same time pull the upper hoop cable 1 and the lower hoop cable 1' of the second layer for forming a stable and self-balanced open cable bar structure of two layers.

(3) Similarly, complete installation and pre-stress construction of other layers. For the top layer without hoop cables, the method of elongating the elastic jack post in that layer can be used for introducing pre-stress, till the construction of the integral structure of cable dome is done.

(4) After construction of the structure, lock and fix the hoop cables and the cable bar nodes to form hinge joint without sliding but turning. As shown in FIG. 4, FIG. 11, FIG. 12 and FIG. 13, after completing all the construction and formation of the cable dome structure and after calibrating the pre-stress and the distortion of the whole cable dome structure, screw the bolt 16 into the bolt hole 5 on the elliptic steel ring 4 to reach the hoop cable and lock and fix the hoop cable with the hoop cable node to avoid sliding. In the same manner, finish locking and fixing of all hoop cables with all cable bar nodes and make the whole structure obtain the maximum bearing capacity. Then, construct the roof on the structure.

III. Another Construction Method of Layer-by-Layer Double-Hoop Sunflower-Shaped Cable Dome Structure As shown in FIG. 4, FIG. 7, FIG. 8, FIG. 9, FIG. 12 and FIG. 13, comprising the cycles of jack posts 3 of elevation having several units arranged with same space in each layer with same geometric characters and of same quantity except of the top layer, it is characterized that: the upper end and the lower end of jack post 3 of each unit are installed with an upper cable bar node and a lower cable bar node. The upper cable bar node is connected with two upper stayed cables (bars) 2 of the present layer at one side, two upper stayed cables (bars) 2 of the layer above and two lower stayed cables (bars) 2' of the layer above at another side and an upper hoop cable going through the middle of the upper cable bar node 1. The lower cable bar node is connected with two lower stayed cables (bars) 2' of the present layer and a lower hoop cable 1' going through the middle of the lower cable bar node.

As shown in FIG. 10, the top layer comprises an upper cable bar node, a lower cable bar node and an elastic jack post. The upper cable bar node is connected with all upper stayed cables (bars) 2 of the top layer and the lower cable bar node is connected with all lower stayed cables (bars) 2' of the top layer. The elastic jack post comprises a jack post having left-hand thread 14, a jack post having right-hand thread 14' and a bushing 15.

(1) Install and connect an end of the upper stayed cable (bar) 2 and the lower stayed cable (bar) 2' of the first layer with the base of the building and another end of the upper stayed cable (bar) 2 and the lower stayed cable (bar) 2' of the first layer with the upper cable bar node and the lower cable bar node of the two ends of the corresponding jack post 3 of the first layer, install the upper hoop cable 1 and the lower hoop cable 1' inside the upper cable bar node and the lower cable bar node, connect an end of the upper stayed cable (bar) 2 and the lower stayed cable (bar) 2' of the second layer with the upper cable bar node of the first layer, connect another end of the upper stayed cable (bar) 2 and the lower stayed cable (bar) 2' of the second layer with the upper cable bar node and the lower cable bar node of the two ends of the corresponding jack post 3 of the second layer, install the upper hoop cable 1 and the lower hoop cable 1' of the second layer inside the upper cable bar node and the lower cable bar node, finish the connection of the parts of the whole cable dome structure in the same manner.

(2) Pull at the same time the upper hoop cable 1 and the lower hoop cable 1' layer by layer. For the top layer without hoop cable, the method of elongating the elastic jack post in that layer can be used for the introduction of pre-stress, till the construction of the integral structure of the cable dome is done.

(3) After construction of the cable dome structure, lock and fix the hoop cables and the cable bar nodes to form hinge joint without sliding but turning. As shown in FIG. 4, FIG. 11, FIG. 12 and FIG. 13, after completing all the construction and formation of the cable dome structure and after calibrating the pre-stress and the distortion of the whole cable dome structure, screw the bolt 16 into the bolt hole 5 on the elliptic steel ring 4 to reach the hoop cable and lock and fix the hoop cable with the hoop cable node to avoid sliding. In the same manner, finish the locking and fixing of all hoop cables with all cable bar nodes and make the whole structure obtain the maximum bearing capacity. Then, construct the roof on the structure.

The invention claimed is:

1. A construction method for constructing a double-hoop sunflower-shaped cable dome structure, the method comprising:

(1) providing a top circle having a vertical length-adjustable pole in connection with a plurality of radiating cables, and providing a first, at least one second and a third lower circle of vertical jack posts in connection with said plurality of radiating cables and a plurality of hoop cables;

the lower circles of jack posts being connected to one another through the plurality of radiating cables and the plurality of hoop cables to form a frame which is arch shape when viewed from the side and co-centrally circularly shaped when viewed from above;

the jack posts being vertically supported by the radiating cables and the hoop cables; said plurality of lower circles each having a diameter and being vertically arranged so that, the diameter of the first circle is smaller than the diameter of the at least one second circle, and the diameter of the at least one second circle is smaller than the diameter of the third circle; the jack posts within each circle being evenly spaced;

an upper end and a lower end of each jack post of each circle being installed with an upper cable bar node and a lower cable bar node, respectively; each upper cable bar node being connected with four upper radiating cables and two lower radiating cables of one of the circles and an upper hoop cable going through a middle part of the upper cable bar node; the lower cable bar node being connected with two lower radiating cables and a lower hoop cable going through a middle of the lower cable bar node;

the vertical length-adjustable pole of the top circle comprises a vertical sleeve bushing with inner screw threads, a first threaded rod connecting with an upper end of the sleeve bushing, a second threaded rod connecting with a lower end of the sleeve, a top circle upper cable bar node connecting with the first threaded rod, and a top circle lower cable bar node connecting with the second threaded rod; the top circle upper cable bar node being connected with all upper radiating cables of the top circle and the top circle lower cable bar node being connected with all lower radiating cables of the top circle;

radiating cables from at least one of the lower circles are adapted to be connected to an object to which the cable dome structure is attached; and the jack posts of the plurality of lower circles are rigid, the radiating cables and hoop cables are tensioned;

(2) connecting an end of one of the upper radiating cables and an end of one of the lower radiating cables of the third circle with the object to which the cable dome structure is attached and connecting another end of the upper radiating cable and another end of the lower radiating cable of each circle respectively with the upper cable bar node and the lower cable bar node at the end of a corresponding jack post of the circle, installing the upper hoop cable and the lower hoop cable respectively inside the upper cable bar node and the lower cable bar node, at the same time pulling and tensioning the upper hoop cable and the lower hoop cable of the circle to form a stable and self-balanced open cable bar structure of the circle;

(3) installing and connecting an end of the upper radiating cable and an end of the lower radiating cable of the at least one second circle with the upper cable bar node of the third circle and another end of the upper radiating cable and another end of the lower radiating cable of the at least one second circle with the upper cable bar node and the lower cable bar node at the end of the corresponding jack post of the at least one second circle, installing one of the upper hoop cables and one of the lower hoop cables of the at least one second circle inside the upper cable bar node and the lower cable bar node, respectively, at the same time pulling and tensioning the upper hoop cable and the lower hoop cable of the at least one second circle to form a stable and self-balanced open cable bar structure of the at least one second and third circles;

(4) repeating step (3) to complete installation and pre-stress construction of the first circle; elongating the length-adjustable pole of the top circle layer for introducing pre-stress force, till completing the construction of the top circle and all lower circles; and (5) locking and fixing the hoop cables and the cable bar nodes to form a non-slidable but rotatable hinge joint to complete the construction of the cable dome structure.

2. The method according to claim 1, wherein said upper cable bar node is an elliptic steel ring, a narrow side of said elliptic steel ring is welded with a first hanger lug and a second hanger lug connected respectively with upper radiating cables of one of the circles, the first and the second hanger lugs are connected respectively with the upper radiating cables of the circle, and another narrow side of said elliptic steel ring is welded with a third hanger lug and a fourth hanger lug connected respectively with two upper radiating cables of the circle above and with a fifth hanger lug and a sixth hanger lug connected respectively with two lower radiating cables of the circle above, the third and the fourth hanger lugs are connected respectively with the own upper radiating cables of the circle above, the fifth and the sixth hanger lugs are connected respectively with the lower radiating cables of the circle above, and between two wide sides of said elliptic steel ring a hollow concaved ring is installed with one side of which having a sliding connection with the upper hoop cable.

3. The method according to claim 1, wherein said lower cable bar node is another elliptic steel ring, a narrow side of said elliptic steel ring is welded with a seventh hanger lug and an eighth hanger lug connected respectively with lower radiating cables of one of the circles, the seventh and the eighth hanger lugs are connected respectively with the lower radiating cables of the present circle, and between two wide sides of said elliptic steel ring a hollow concaved ring is installed with one side of which having a sliding connection with the lower hoop cable.

4. The method according to claim 1, wherein said upper cable bar node of the top circle is arranged with hanger lugs of the upper radiating cables of the top circle and the hanger lugs are connected respectively with all upper radiating cables of the top circle, said lower cable bar node of the top circle is arranged with hanger lugs of the lower radiating cables of the top circle and the hanger lugs are connected respectively with all lower radiating cables of the top circle.

5. A construction method for constructing a double-hoop sunflower-shaped cable dome structure the method comprising:

(1) providing a top circle having a vertical length-adjustable pole in connection with a plurality of radiating cables, and providing a first, at least one second and a third lower circle of vertical jack posts in connection with said plurality of radiating cables and a plurality of hoop cables;

the lower circles of jack posts being connected to one another through the plurality of radiating cables and the plurality of hoop cables to form a frame which is arch shape when viewed from the side and co-centrally circularly shaped when viewed from above;

the jack posts being vertically supported by the radiating cables and the hoop cables; said plurality of lower circles each having a diameter and being vertically arranged so that the diameter of the first circle is smaller than the diameter of the at least one second circle, and the diameter of the at least one second circle is smaller than the diameter of the third circle; the jack posts within each circle being evenly spaced;

an upper end and a lower end of each jack post of each circle being installed with an upper cable bar node and a lower cable bar node, respectively; each upper cable bar node being connected with four upper radiating cables and two lower radiating cables of one of the circles and an upper hoop cable going through a middle part of the upper cable bar node; the lower cable bar node being connected with two lower radiating cables and a lower hoop cable going through a middle of the lower cable bar node;

the vertical length-adjustable pole of the top circle comprises a vertical sleeve bushing with inner screw threads, a first threaded rod connecting with an upper end of the sleeve bushing, a second threaded rod connecting with a lower end of the sleeve, a top circle upper cable bar node connecting with the first threaded rod, and a top circle lower cable bar node connecting with the second threaded rod; the top circle upper cable bar node being connected with all upper radiating cables of the top circle and the top circle lower cable bar node being connected with all lower radiating cables of the top circle;

radiating cables from at least one of the lower circles are adapted to be connected to an object to which the cable dome structure is attached; and the jack posts of the plurality of lower circles are rigid, the radiating cables and hoop cables are tensioned;

(2) connecting an end of one of the upper radiating cables and an end of one of the lower radiating cables of the third circle with the object to which the cable dome structure is attached and connecting another end of the upper radiating cable and another end of the lower radiating cable of each circle respectively with the upper cable bar node and the lower cable bar node at the end of a corresponding jack post of the circle, installing the upper hoop cable and the lower hoop cable respectively inside the upper cable bar node and the lower cable bar node;

(3) connecting an end of the upper radiating cable and an end of the lower radiating cable of the at least one second with the upper cable bar node of the third circle and another end of the upper radiating cable and another end of the lower radiating cable of the at least one second circle with the upper cable bar node and the lower cable bar node at the end of the corresponding jack post of the at least one second circle, installing one of the upper hoop cables and one of the lower hoop cables of the at least one second circle inside the upper cable bar node and the lower cable bar node, respectively;

(4) pulling and tensioning at the same time the upper hoop cables and the lower hoop cables circle by circle; elongating the elastic pole in the top circle to introduce pre-stress force; till completing the construction of the top circle and all lower circles;

(5) after construction of the cable dome structure, locking and fixing the hoop cables and the cable bar nodes to form a non-slidable but rotatable hinge joint to complete the construction of the cable dome structure.

* * * * *